US006014961A

United States Patent [19]

Gates

[11] Patent Number: 6,014,961

[45] Date of Patent: Jan. 18, 2000

[54] INTERNAL COMBUSTION ENGINE INTAKE SENSING SYSTEM

[75] Inventor: Freeman Carter Gates, Bloomfield Hills, Mich.

[73] Assignee: Ford Global Technologies, Inc., Dearborn, Mich.

[21] Appl. No.: 09/120,747

[22] Filed: Jul. 23, 1998

[51] Int. Cl.[7] ..... F02M 25/07; F02M 37/04

[52] U.S. Cl. ..... 123/568.21; 123/568.27; 123/497

[58] Field of Search ..... 123/458, 497, 123/568.11, 568.16, 568.17, 568.18, 568.21, 568.23, 568.24, 568.25, 568.26, 568.27, 568.28; 73/31.04, 723

[56] References Cited

U.S. PATENT DOCUMENTS

| | | | |
|---|---|---|---|
| 4,257,381 | 3/1981 | Yuzawa et al. | 477/111 |
| 4,274,385 | 6/1981 | Yuzawa et al. | 123/568.27 |
| 4,290,404 | 9/1981 | Hata et al. | 123/478 |
| 4,318,385 | 3/1982 | Yamaguchi | 123/676 |
| 4,390,001 | 6/1983 | Fujimoto | 123/568.2 |
| 4,428,354 | 1/1984 | Sundeen et al. | 123/568.28 |
| 5,133,323 | 7/1992 | Treusch | 123/494 |
| 5,190,017 | 3/1993 | Cullen et al. | 123/568.16 |
| 5,241,940 | 9/1993 | Gates, Jr. | 123/568.27 |
| 5,355,859 | 10/1994 | Weber | 123/497 |
| 5,443,046 | 8/1995 | White | 123/438 |
| 5,515,833 | 5/1996 | Cullen et al. | 123/568.27 |
| 5,542,395 | 8/1996 | Tuckey et al. | 123/497 |
| 5,546,911 | 8/1996 | Iwamoto et al. | 123/497 |
| 5,577,484 | 11/1996 | Izutani et al. | 123/568.16 |
| 5,579,738 | 12/1996 | Frischmuth et al. | 123/497 |
| 5,586,539 | 12/1996 | Yonekawa et al. | 123/497 |
| 5,590,631 | 1/1997 | Tuckey | 123/447 |
| 5,613,479 | 3/1997 | Gates et al. | 123/568.27 |
| 5,819,709 | 10/1998 | Holmes et al. | 123/497 |
| 5,848,583 | 12/1998 | Smith et al. | 123/497 |

*Primary Examiner*—Willis R. Wolfe
*Attorney, Agent, or Firm*—Jerome R. Drouillard

[57] ABSTRACT

A pressure sensing system for an internal combustion engine including an intake manifold (20) and an exhaust manifold (24), with an EGR valve assembly (30) mounted thereto. A sensor housing (60) includes three absolute sensors (80, 82, 84) for measuring absolute EGR pressure, manifold absolute pressure, and fuel rail pressure. The passages (28, 68) for the EGR flow and for measuring the EGR and MAP are internal to the EGR assembly and manifolds, thus eliminating separate hoses. The orifice (76) within the EGR passages (28, 68) is located downstream of the EGR valve to allow for pressure downstream of the orifice to be MAP pressure.

15 Claims, 3 Drawing Sheets

INTERNAL COMBUSTION ENGINE INTAKE SENSING SYSTEM

FIELD OF THE INVENTION

The present invention relates to sensing systems for determining the intake of fuel, air and exhaust gasses into an internal combustion engine.

BACKGROUND OF THE INVENTION

A conventional sensor system for monitoring the operating parameters needed to determine the pressure in the intake manifold and the pressure seen by the exhaust gas recirculation (EGR) valve includes an absolute pressure sensor having a tap directly into the intake plenum to determine the manifold absolute pressure (MAP) and a separate sensor assembly for the EGR pressure. The EGR pressure sensor assembly typically includes an orifice mounted in an EGR tube just downstream of the location where the EGR tube taps into the exhaust stream, with pressure taps coming off of the EGR tube on both the upstream and the downstream side of the orifice. The two taps are connected to hoses that feed into a relative pressure sensor that compares the upstream and downstream pressures to obtain the delta pressure feedback exhaust (DPFE) signal. This signal is then used, along with the MAP and other signals to determine the valve opening for an EGR valve.

There are several drawbacks to this technique, however, in that there are two taps and two sets of hoses needed to obtain one DPFE pressure measurement, in addition to a separate MAP sensor. This then leads to the need for two separate sensor assemblies. Further, the location of the EGR taps and orifice, being close to where the EGR tube taps into the exhaust stream, are exposed to a great deal of heat, and so relatively expensive materials must be employed to withstand this heat and operate over the life of a vehicle. Further, during engine start-up in cold weather, these hoses can suffer from ice formation, creating limited EGR functioning.

Moreover, with these types of sensor configurations, there is no real option to run the pressure measurement lines through the housings of main engine components, so they must use separate hoses and connectors, creating more parts and more potential for reliability concerns.

Also of consideration for vehicles today is the desire to operate the fuel system as a returnless system. This generally requires a sensor at some point of the fuel system to measure the fuel pressure. This, then, along with the MAP and other signals are used to operate a fuel pump and the fuel injectors. However, this again adds more hoses and sensor assemblies to the overall sensor system, thus increasing cost and creating potential reliability concerns.

Consequently, an inexpensive, reliable and accurate sensing system is desired for use with internal combustion engines on vehicles.

SUMMARY OF THE INVENTION

In its embodiments, the present invention contemplates a pressure sensing system for an internal combustion engine. The system includes intake manifold having an outer wall defining a plenum enclosed therein, with an air intake opening through the outer wall intersecting the plenum, a manifold pressure passage through the main wall intersecting the main plenum, a portion of a recirculation pressure passage extending through a portion of the outer wall, and a portion of a downstream recirculation passage extending through the outer wall. Also, air throttling means is included for selectively restricting the air intake opening. An exhaust manifold has an outer wall defining an exhaust chamber enclosed therein, with an exhaust opening through the outer wall intersecting the exhaust chamber and a portion of an upstream recirculation passage extending through the outer wall. An exhaust gas recirculation valve assembly is mounted to the intake manifold and the exhaust manifold, including a second portion of the downstream recirculation passage aligned with the downstream recirculation passage of the intake manifold, a second portion of the upstream recirculation passage aligned with the upstream recirculation passage of the exhaust manifold, with a valve therebetween, and means for adjusting the valve. An orifice is located in the downstream pressure passage for creating a restriction in the downstream passage. For this system, the recirculation pressure passage intersects the downstream pressure passage between the orifice and the valve. A sensor housing is located adjacent to the intake manifold, a first absolute pressure sensor is mounted in the sensor housing operatively engaging the recirculation pressure passage, and a second absolute pressure sensor is mounted in the sensor housing, operatively engaging the manifold pressure passage.

Accordingly, an object of the sent invention is to provide an accurate sensing system for measuring EGR pressure and MAP, along with fuel injector pressure, while minimizing the cost and complexity of the system.

A further object of the present invention is to provide an EGR valve arrangement that minimizes the need for separate hoses used in taking pressure measurements and wherein absolute pressure sensors can be packaged in a single housing.

An advantage of the present invention is that there are three separate absolute sensors all operating in one housing, with each needing only one input, that will produce sensor signals for EGR control, MAP and fuel injector pressure, thus generating needed signals for fuel injector returnless fuel systems, for manifold absolute pressure determination, and for controlling the EGR valve.

A further advantage of the present invention is that the sensor reading for the EGR pressure is far removed from the main exhaust stream (i.e., downstream of the EGR valve), thus allowing for lower cost materials because of the reduced temperatures of the exhaust gasses at the location of the measurement. Further, this location for the sensor reading reduces any exhaust pulsation concerns due to the pulsations in the flow of the exhaust gasses in the main exhaust stream.

Another advantage of the present invention is that the housing for the sensors is mounted close to where the taps are and also, the pressure passages for the EGR and MAP can be routed directly through the walls of the intake manifold if so desired.

DETAILED DESCRIPTION OF THE PREFERRED EMBODIMENTS

Figure 1:
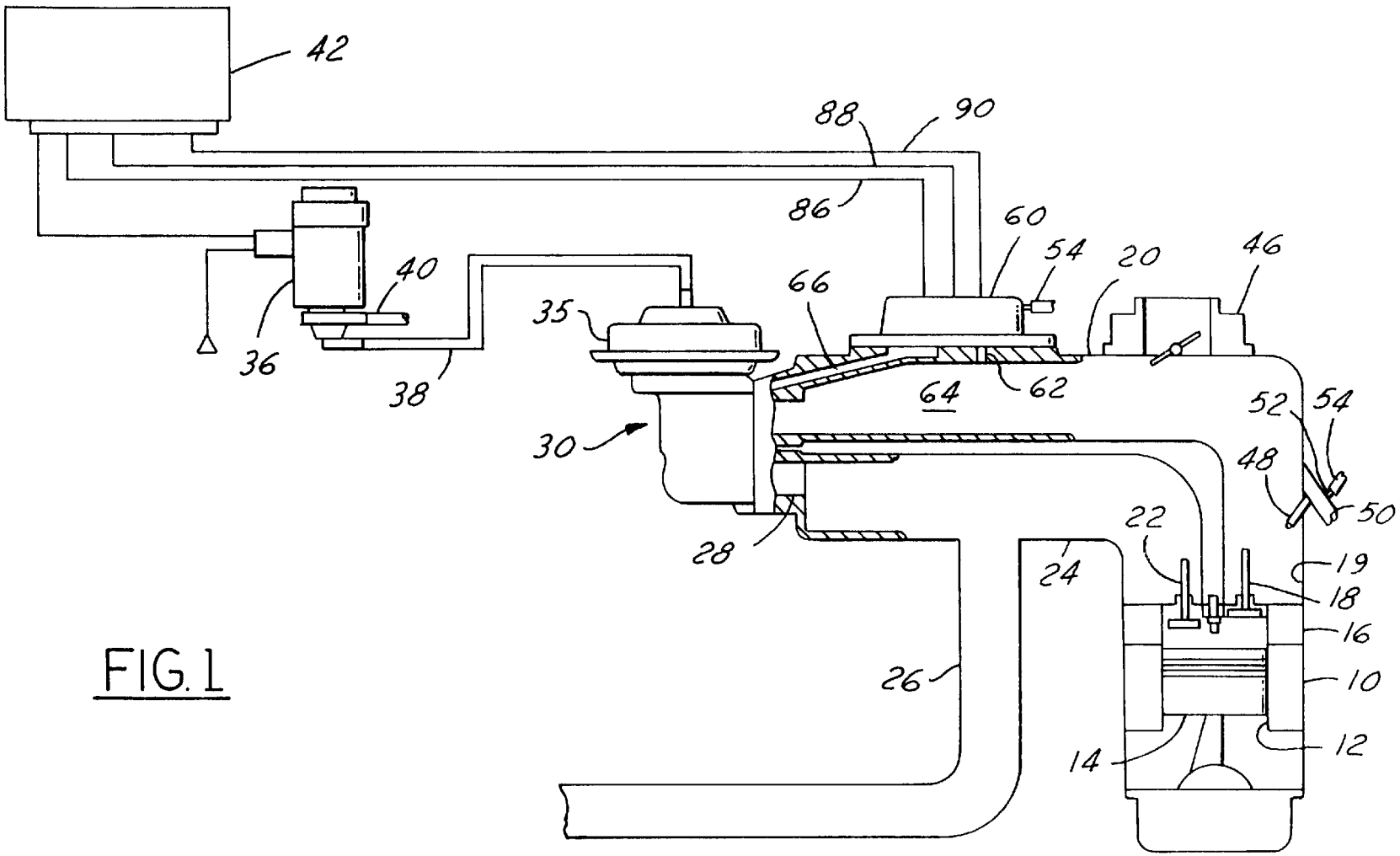
FIG. 1 is a schematic representation of an engine assembly, including portions of the intake and exhaust system and the sensor assembly, in accordance with the present invention.
Figure 2:
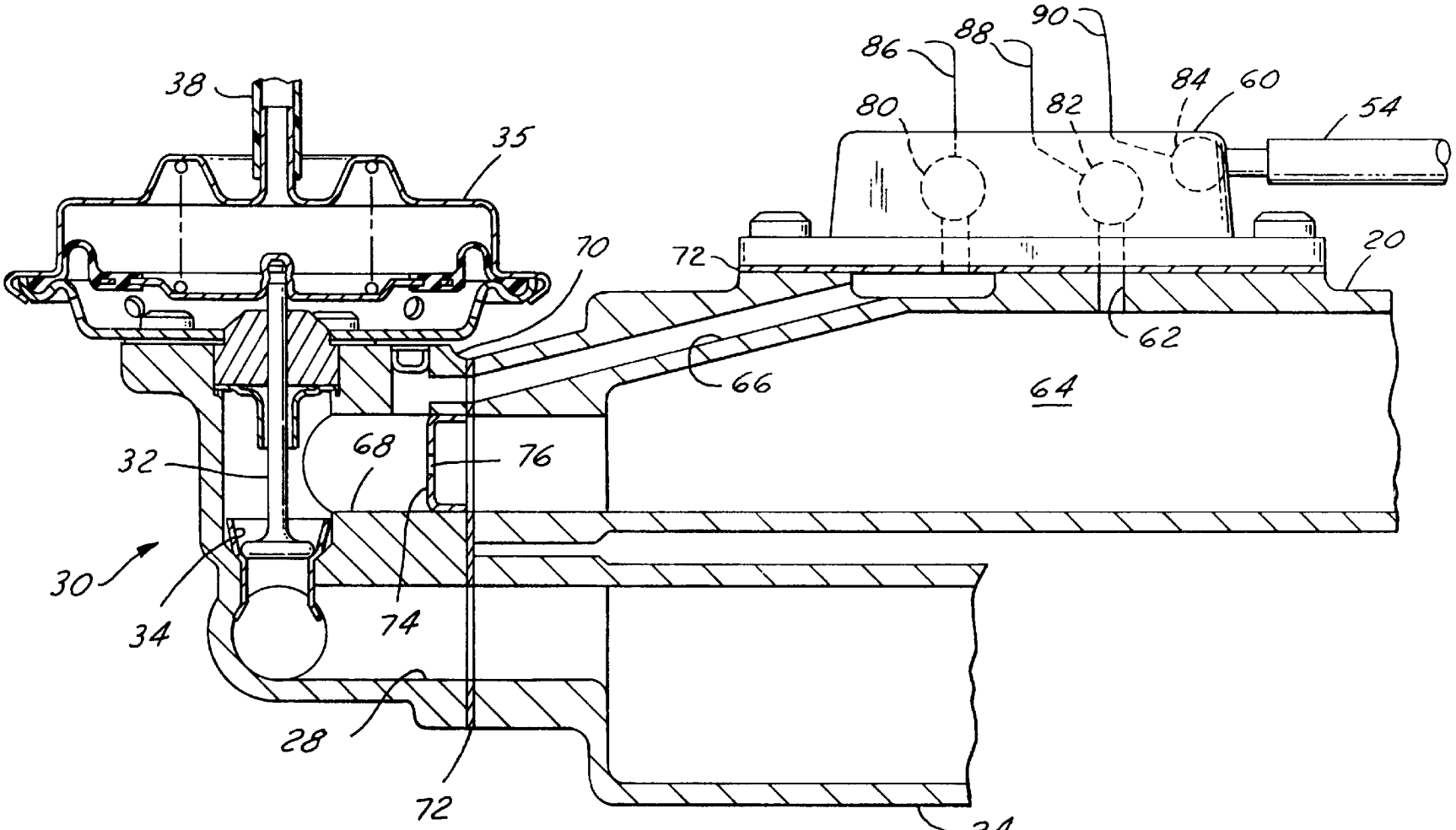
FIG. 2 is an enlarged view of a portion of FIG. 1.
Figure 3:
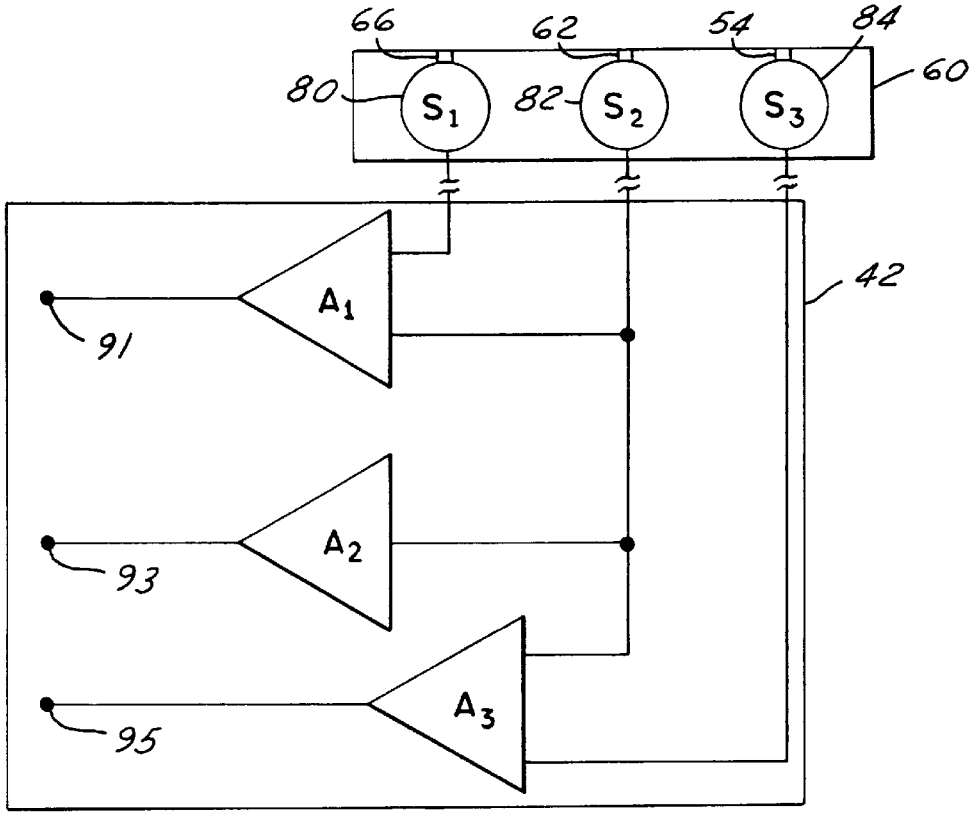
FIG. 3 is a schematic diagram of the sensor assembly and signal processing in accordance with the present invention.

FIGS. 1–3 illustrate a portion of an engine assembly and sensor system including a cylinder block 10 defining cylinders 12, and having pistons 14 mounted within the cylinders in a conventional fashion. A cylinder head 16 mounts on the cylinder block 10 and includes intake valves 18 for selectively receiving a fuel/air mixture from air intake passages 19, leading from an intake manifold 20, and exhaust valves 22 for selectively discharging exhaust gasses into an exhaust manifold 24. The exhaust manifold 24 leads to an exhaust pipe 26, and eventually out to the atmosphere, as in conventional engine configurations.

An EGR passage 28 extends through the wall of the exhaust manifold 24 and taps into it in order to allow for some of the exhaust to be selectively diverted into the intake manifold 20. The EGR passage 28 extends between the exhaust manifold 24 and an EGR valve 30, mounted to the exhaust manifold 24. The EGR valve 30 controls the flow of the EGR gasses via a pintle 32 being moved up and down relative to an orifice 34 by a vacuum controlled valve mechanism 35. The vacuum in the valve is varied by an EGR vacuum regulator 36 connected to the EGR valve 30 via tubing 38. The EGR regulator 36 also includes a reference tube 40 that taps into the intake manifold 20 in a conventional fashion. The EGR regulator 36 is, in turn, electronically controlled in a conventional fashion by a powertrain control module (PCM) 42.

The EGR valve 30 is also mounted to the intake manifold 20. The intake manifold 20 has a throttle body 46 mounted thereto at an air intake opening for controlling the flow of intake air in a conventional fashion. Downstream thereof, along the air intake passage 19, a fuel injector 48 is mounted to the intake manifold 20. The fuel injector 48 is also connected to a fuel rail 50, in a conventional fashion. There is a tap 52 into the fuel rail 50 connected to a fuel pressure hose 54, leading to a main sensor housing 60. The pressure in the fuel rail is sensed through this hose 54.

The main sensor housing 60 also connects to two other passages leading thereto. A MAP passage 62 is formed through the wall of the intake manifold 20, extending to the intake manifold plenum 64, and an upstream EGR pressure passage 66 extends from an EGR outlet passage 68 leading from the pintle valve 32, through the housing 70 of the EGR valve 30 and the wall of the intake manifold 20, to the sensor housing 60. By mounting the EGR valve 30 directly to the intake manifold 20 and exhaust manifold 24, with the EGR pressure passage 66 and the MAP pressure passage 62 incorporated internally in the manifolds 20, 24 and EGR housing 70, and sealed with interface gaskets 72, the need for separate hoses and clamps is eliminated. This substantially reduces the number of parts and associated reliability concerns. Moreover, allowing for the pressure passages to be incorporated internally is only economically feasible and practicable if the orifice needed for pressure measurements relating to the EGR system is located downstream of the EGR valve, close to both the intake and exhaust manifolds.

There is an insert 74 located within the outlet passage 68, downstream of the intersection of the outlet passage 68 and the upstream EGR passage 66. The insert 74 includes an orifice 76 therethrough, allowing for the flow of EGR gas while creating a measurable pressure difference between the upstream side of the insert 74 and the downstream side of the insert 74. In this way, the upstream EGR pressure passage 66 is exposed to the pressure around the EGR valve, while downstream of the insert, the pressure is the MAP. This MAP is read via the MAP passage, thus not requiring a separate sensor and sensor passage just downstream of the insert 74 in order to obtain the pressure difference across the insert 74.

Contained within the sensor housing 60 are three absolute pressure sensors, one each associated with a respective one of the pressure passages. Each of the sensors is an absolute sensor, so there is only one input needed for each one. The absolute sensors can be silicon capacitive, piezoresistive, ceramic capacitive, etc. as desired.

The first sensor 80 is mounted in the sensor housing 60 and is in communication with the EGR pressure passage 66. The second sensor 82 is mounted in the sensor housing 60 and is in communication with the MAP pressure passage 62, and the third sensor 84 is also mounted in the housing in communication with the fuel pressure passage 54. Each of the sensors 80, 82 and 84 includes electrical connections 86, 88 and 90, respectively, to the powertrain control module 42.

The first sensor 80 produces a signal $S_1$ corresponding to the pressure in the EGR pressure passage 66, the second sensor 82 produces a signal $S_2$ corresponding to the MAP pressure in the MAP pressure passage 62, and the third sensor 84 produces a signal $S_3$ corresponding to the fuel pressure in the fuel pressure hose 54. The signals $S_1$, $S_2$ and $S_3$ are then received by the powertrain control module 42 through the respective electrical connections 86, 88 and 90.

The powertrain control module 42 then processes the three absolute pressure signals in order to obtain the desired output signals, which are then used in other areas of the module to control various engine operating parameters. This processing can be accomplished by an electronic circuit or by employing software; and this can be done with a separate control module if so desired rather than within the powertrain control module 42.

A DPFE output signal 91 is created by feeding signals $S_1$ and $S_2$ through a difference amplifier $A_1$ to calculate a value $K_1$ $(S_1–S_2)$, where $K_1$ is a gain factor and the difference between $S_1$ and $S_2$, is the difference between the sensed EGR pressure and MAP. The DPFE output signal 91 is then used in a conventional fashion to determine the valve position needed for the EGR valve 30 in order to obtain the desired flow of EGR gasses.

An injector pressure output signal 95 is created by feeding signals $S_2$ and $S_3$ through a difference amplifier $A_3$ to calculate a value $K_3$ $(S_3–S_2)$, where $K_3$ is a gain factor and the difference between $S_3$ and $S_2$ is the difference between the injector fuel pressure and the MAP. The injector pressure output signal 95 is then used to control a fuel pump (not shown) for a returnless fuel system.

Since the second sensor 82 is an absolute sensor that measures the MAP directly, amplifier $A_2$ merely multiplies the MAP signal $S_2$ by a gain factor $K_2$ to produce a MAP output signal 93.

Figure 4:
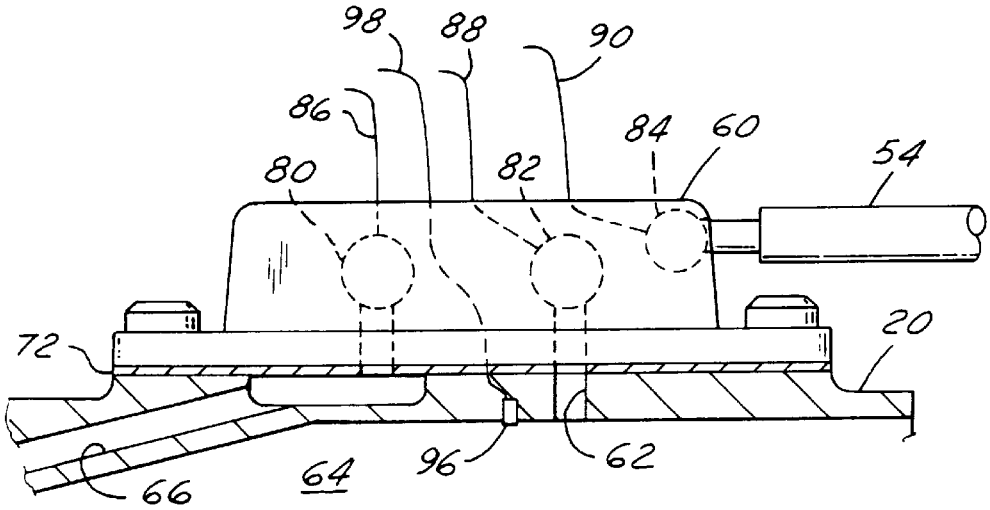
FIG. 4 is a view similar to a portion of FIG. 2, illustrating an alternate embodiment of the present invention.

FIG. 4 illustrates an alternate embodiment of the present invention where a more accurate MAP reading is obtainable. In this embodiment, a thermistor element 96 is added to detect the temperature of the air in the ntake manifold 20 and transmit this signal via line 98 to the powertrain control module 42 (FIG. 1). In this way, the MAP sensor output signal 93 can be adjusted to account for temperature differences of the air within the intake manifold itself. The other two signals do not need to be adjusted for temperature changes, however, since the end result of the calculations is a difference between two pressures that are both read at and effected by the temperature at the time of measurement.

While certain embodiments of the present invention have been described in detail, those familiar with the art to which this invention relatels recognize various alternative designs and embodiments for practicing the invention as defined by the following claims.

I claim:

1. A pressure sensing system for an internal combustion engine comprising:

an intake manifold having an outer wall defining a plenum enclosed therein, with an air intake opening through the outer wall intersecting the plenum, a manifold pressure passage through the main wall intersecting the main plenum, a portion of a recirculation pressure passage extending through a portion of the outer wall, and a portion of a downstream recirculation passage extending through the outer wall;

air throttling means for selectively restricting the air intake opening;

an exhaust manifold having an outer wall defining an exhaust chamber enclosed therein, with an exhaust opening through the outer wall intersecting the exhaust chamber and a portion of an upstream recirculation passage extending through the outer wall;

an exhaust gas recirculation valve assembly mounted to the intake manifold and the exhaust manifold including a second portion of the downstream recirculation passage aligned with the downstream recirculation passage of the intake manifold, a second portion of the upstream recirculation passage aligned with the upstream recirculation passage of the exhaust manifold, with a valve therebetween, and means for adjusting the valve;

an orifice located in the downstream pressure passage for creating a restriction in the downstream passage;

the recirculation pressure passage intersecting the downstream pressure passage between the orifice and the valve;

a sensor housing mounted to the intake manifold;

a first absolute pressure sensor mounted in the sensor housing operatively engaging the recirculation pressure passage;

a second absolute pressure sensor mounted in the sensor housing, operatively engaging the manifold pressure passage;

an electronic controller; and means for transmitting signals from the first and the second sensors to the controller.

2. A pressure sensing system for an internal combustion engine comprising:

an intake manifold having an outer wall defining a plenum enclosed therein, with an air intake opening through the outer wall intersecting the plenum, a manifold pressure passage through the main wall intersecting the main plenum, a portion of a recirculation pressure passage extending through a portion of the outer wall, and a portion of a downstream recirculation passage extending through the outer wall;

air throttling means for selectively restricting the air intake opening;

an exhaust manifold having an outer wall defining an exhaust chamber enclosed therein, with an exhaust opening through the outer wall intersecting the exhaust chamber and a portion of an upstream recirculation passage extending through the outer wall;

an exhaust gas recirculation valve assembly mounted to the intake manifold and the exhaust manifold including a second portion of the downstream recirculation passage aligned with the downstream recirculation passage of the intake manifold, a second portion of the upstream recirculation passage aligned with the upstream recirculation passage of the exhaust manifold, with a valve therebetween, and means for adjusting the valve;

an orifice located in the downstream pressure passage for creating a restriction in the downstream passage;

the recirculation pressure passage intersecting the downstream pressure passage between the orifice and the valve;

a sensor housing mounted to the intake manifold;

a first absolute pressure sensor mounted in the sensor housing operatively engaging the recirculation pressure passage;

a second absolute pressure sensor mounted in the sensor housing, operatively engaging the manifold pressure passage;

a fuel pressure hose adapted to engage a fuel rail at a first end and operatively engaging the sensor housing at a second end; and a third absolute pressure sensor mounted in the sensor housing operatively engaging the second end of the fuel pressure hose.

3. The pressure sensing system of claim 2 wherein the orifice is located in the portion of the downstream passage that is contained within the EGR valve, with the EGR valve further including a recirculation pressure passage aligned with the recirculation pressure passage of the intake manifold.

4. A pressure sensing system for an internal combustion engine comprising:

an intake manifold having an outer wall defining a plenum enclosed therein, with an air intake opening through the outer wall intersecting the plenum, a manifold pressure passage through the main wall intersecting the main plenum, a portion of a recirculation pressure passage extending through a portion of the outer wall, and a portion of a downstream recirculation passage extending through the outer wall;

air throttling means for selectively restricting the air intake opening;

an exhaust manifold having an outer wall defining an exhaust chamber enclosed therein, with an exhaust opening through the outer wall intersecting the exhaust chamber and a portion of an upstream recirculation passage extending through the outer wall;

an exhaust gas recirculation valve assembly mounted to the intake manifold and the exhaust manifold including a second portion of the downstream recirculation passage aligned with the downstream recirculation passage of the intake manifold, a second portion of the upstream recirculation passage aligned with the upstream recirculation passage of the exhaust manifold, with a valve therebetween, and means for adjusting the valve;

an orifice located in the downstream pressure passage for creating a restriction in the downstream passage;

the recirculation pressure passage intersecting the downstream pressure passage between the orifice and the valve;

a sensor housing located adjacent to the intake manifold;

a first absolute pressure sensor mounted in the sensor housing operatively engaging the recirculation pressure passage; and a second absolute pressure sensor mounted in the sensor housing, operatively engaging the manifold pressure passage.

5. The pressure sensing system of claim 4 wherein the orifice is located in the portion of the downstream passage that is contained within the EGR valve, with the EGR valve further including a recirculation pressure passage aligned with the recirculation pressure passage of the intake manifold.

6. The pressure sensing system of claim 4 further including a temperature means for detecting the temperature within the plenum of the intake manifold.

7. The pressure sensing system of claim 4 further comprising an electronic controller, and means for transmitting signals from the first and the second sensors to the controller.

8. The pressure sensing system of claim 7 further including means, within the electronic controller, for subtracting a signal from the second sensor from a signal from the first sensor to produce a delta pressure feedback exhaust signal.

9. The pressure sensing system of claim 4 further comprising:

a fuel pressure hose adapted to engage a fuel rail at a first end and operatively engaging the sensor housing at a second end; and a third absolute pressure sensor mounted in the sensor housing operatively engaging the second end of the fuel pressure hose.

10. The pressure sensing system of claim 9 further comprising an electronic controller, and means for transmitting signals from the first, second and third sensors to the controller.

11. The pressure sensing system of claim 10 further comprising:

means, within the electronic controller, for subtracting a signal from the second sensor from a signal from the first sensor to produce a delta pressure feedback exhaust signal; and means, within the electronic controller, for subtracting a signal from the second sensor from a signal from the first sensor to produce an injector pressure signal.

12. The pressure sensing system of claim 10 further including means, within the electronic controller, for subtracting a signal from the second sensor from a signal from the first sensor to produce a delta pressure feedback exhaust signal.

13. The pressure sensing systeme of claim 12 further including means, within the electronic controller, for subtracting a signal from the second sensor from a signal from the first sensor to produce an injector pressure signal.

14. The pressure sensing system of claim 13 further including a temperature means for detecting the temperature within the plenum of the intake manifold.

15. The pressure sensing system of claim 14 wherein the temperature means is a thermistor.

* * * * *